US006353967B1

(12) United States Patent
Escobar et al.

(10) Patent No.: US 6,353,967 B1
(45) Date of Patent: Mar. 12, 2002

(54) NINETY-DEGREE DOOR HINGE

(76) Inventors: Francisco A. Escobar, 35 School Dr., Sierra Vista, AZ (US) 85635; Samuel A. Salazar, 13970 Vista Sage Pl., Jamul, CA (US) 91936

( * ) Notice: Subject to any disclaimer, the term of this patent is extended or adjusted under 35 U.S.C. 154(b) by 0 days.

(21) Appl. No.: 09/388,903

(22) Filed: Sep. 2, 1999

Related U.S. Application Data

(60) Provisional application No. 60/099,199, filed on Sep. 2, 1998.

(51) Int. Cl.[7] ..... E05D 11/10

(52) U.S. Cl. ..... 16/331; 16/332; 16/374; 16/387

(58) Field of Search ..... 16/331, 374, 375, 16/381, 82, 332, 387

(56) References Cited

U.S. PATENT DOCUMENTS

| | | | | | |
|---|---|---|---|---|---|
| 1,440,713 | A | * | 1/1923 | Ausbourne | 16/381 |
| 1,508,013 | A | * | 9/1924 | Waters | 16/351 |
| 1,603,408 | A | * | 10/1926 | Rickenbacher | 16/331 |
| 2,803,850 | A | * | 8/1957 | Hooper | 16/341 |
| 2,843,873 | A | * | 7/1958 | Slower | 16/331 |
| 3,837,044 | A | | 9/1974 | Goetz, Jr. et al. | |
| 5,287,596 | A | * | 2/1994 | Chen et al. | 16/331 |
| 5,661,875 | A | | 9/1997 | Overcash et al. | 16/82 |
| 5,669,105 | A | | 9/1997 | Depke | 16/248 |
| 5,689,855 | A | | 11/1997 | Tang | 16/235 |
| 5,701,636 | A | | 12/1997 | Jahnke | 16/238 |
| 5,727,289 | A | | 3/1998 | Reder | 16/375 |

FOREIGN PATENT DOCUMENTS

| | | | | |
|---|---|---|---|---|
| CH | 0123074 | * | 10/1948 | 16/374 |
| GB | 0026868 | * | 10/1905 | 16/374 |
| GB | 2190952 A | * | 12/1987 | 16/374 |

* cited by examiner

*Primary Examiner*—Chuck Y. Mah

(57) ABSTRACT

A door hinge which stops the swing-open motion of a door before it can strike an adjacent wall located at ninety degrees to the closed door. By stopping the motion of the door at ninety degrees, the protruding hardware of the door will not penetrate or otherwise damage the adjacent wall. Frequent repairs are therefore avoided. The door hinge is adaptable to various residential and commercial applications.

1 Claim, 1 Drawing Sheet

NINETY-DEGREE DOOR HINGE

RELATED APPLICATIONS

Figure 1:
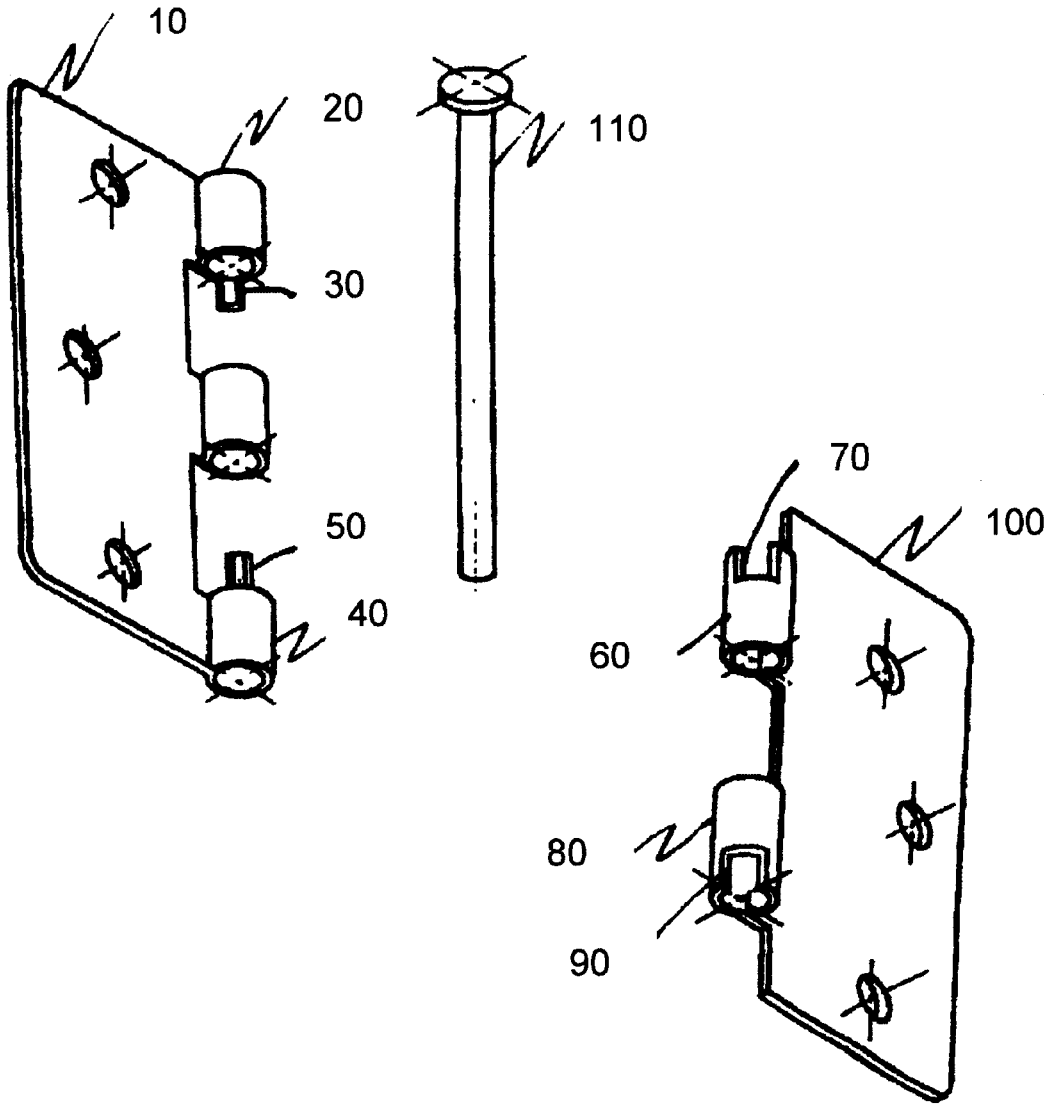

This application relates to a provisional Application No. 60/099,199, filed Sep. 2, 1998, by the same inventors.

BACKGROUND OF THE INVENTION

1. Field of the Invention

The present invention relates generally to the field of hardware for residential and commercial doors and more specifically to the field of devices which limit the swing-open motion of an entry or interior door to a maximum of ninety degrees to prevent the door and protruding hardware from striking an adjacent wall.

2. Description of the Prior Art

The field of devices which limit the swing-open motion of doors has been studied extensively and a number of approaches have been developed. This field is important because without limiting the swing of a door, the protruding hardware can strike and even penetrate an adjacent wall causing damage that requires repair. Most of the devices which are presently used to limit the swing-open motion of a door are mounted to the floor adjacent to the wall to be protected or mounted on the base molding of the wall itself. A review of door hinge devices has not revealed a door hinge for residential or commercial use which incorporates features to address this problem.

One example is of a device to limit the swing-open motion of a door is disclosed in U.S. Pat. No. 3,837,044, issued to Goetz. This door hinge device imparts a snap-action movement to hold a door member in either a closed or an open position. The device has application to light weight door members such as are used in appliances. The device cannot be applied to limiting the swing of a residential or commercial door.

Another example is disclosed in U.S. Pat. No. 5,661,875, issued to Overcash, et al. The device consists of a modified door hinge with a clip-on stop to limit the swing of a door. The maximum swing of a door is limited by the thickness of the block portion of the stop.

In U.S. Pat. No. 5,669,105, issued to Depke, an adjustable door hinge is disclosed. The adjustment of the hinge allows for the adjustment of a door both laterally and axially within a door frame. The device does not provide for any adjustment to the maximum swing of a door.

A novel door hinge structure for mounting a door panel to a door frame is found in U.S. Pat. No. 5,689,855, issued to Tang. The hinge makes no provision for limiting the swing of a door.

Another adjustable door hinge is disclosed in U.S. Pat. No. 5,701,636, issued to Jahnke. The hinge provides for simple adjustment of the relative position of a door element with respect to a door frame. The hinge makes no provision for limiting the swing of a door.

An adjustable hinge mounted door stop is found in U.S. Pat. No. 5,727,289, issued to Reder. The device consists of two stops which rotate on the hinge pin of a modified door hinge assembly. The device can incorporate an adjustment screw to adjust the angular separation of the two stops to set the maximum swing of a door.

Thus, a variety of devices to limit the swing-open motion of a door are known. Most of the devices to limit the swing of a door are not located on incorporated into the door hinge. Of the devices which limit the maximum swing of a door through modifications to a standard door hinge, none provide for a simple device which is easy to install and economical to manufacture.

Accordingly, it would be desirable to develop a hinge, which would be simple and easy to install and would limit the swing-in motion of a door to ninety degrees. This hinge would satisfy the requirements of the most common application of the door stop, the case in which a wall is located immediately adjacent to either the right or the left side of the door frame.

SUMMARY OF THE INVENTION

In view of the foregoing disadvantages inherent in the known types of hinges which limit the maximum swing of door, the present invention makes available a door hinge that has a maximum swing ninety degrees. This ninety-degree door hinge is configured for use on residential and commercial entry and interior doors located ninety-degrees to an adjacent wall. The purpose of this Invention is to stop the swing-open motion of the door before it can strike the adjacent wall. By halting the swing-open motion of said door at ninety degrees, the protruding hardware of a door will not penetrate the adjacent wall causing damage that requires repair. The uniqueness of the present invention is found in the shape of hinge-pin barrels on the door and frame hinge members. The interfacing surfaces of the top and bottom barrel segments of the door elements of the hinge are configured with protruding tabs. The interfacing surfaces of the top and bottom hinge-pin barrel segments of the frame hinge element have corresponding slot receiver shapes. The width of the protruding tabs and the width of the corresponding slots are configured to establish an arc segment of rotation that allows a maximum door swing of ninety degrees. The complete hinge consisting of the door and frame elements are spaced, aligned and pinned at one or all of the three standard hinge positions for each door. The Ninety-Degree Door Hinge is best installed at the time of new construction where a door is framed ninety degrees to an adjacent wall.

BEST MODES FOR CARRYING OUT THE INVENTION

The preferred embodiment of the present invention can be best understood by reference to the drawing. As can be readily seen from the drawing, the invention is a standard door hinge with certain modifications which limit the hinge to a maximum rotation of ninety degrees. FIG. 1 is an exploded isometric view of the invention. Referring to FIG. 1, the door element base plate 10 includes a plurality of cylindrical barrels 20 and 40 having an inside diameter of proper dimension to receive a hinge pin 110. The upper cylindrical barrel 20 includes a tab 30 which extends downward along the vertical axis of the hinge. The lower cylindrical barrel 40 includes a tab 50 which extends upward along the vertical axis of the hinge. The door frame base plate 100 includes a plurality of cylindrical barrels 60 and 80 having an inside diameter of proper dimension to receive a hinge pin 110. The upper cylindrical barrel 60 includes a slot 70 opening upward along the vertical axis of the hinge. The lower cylindrical barrel 80 includes a slot 90 opening downward along the vertical axis of the hinge. The hinge is assembled by aligning tab 30 with slot 70 and likewise aligning tab 50 with slot 90. While maintaining the tabs and slots in their aligned positions, the relative position between the door baseplate 10 and the door frame baseplate 100 is adjusted so that the cylindrical barrels 20, 40, 60 and 80 are aligned along the vertical axis of the hinge. The width of slots 70 and 90 is sufficiently greater than the width of tabs 30 and 50 such that the door baseplate 10 and the door frame baseplate 100 can freely rotate with respect to one another through a maximum of ninety degrees. Further, the slots 70 and 90 and tabs 30 and 50 are keyed to allow the door baseplate 10 and the door frame baseplate 100 to rotate from a closed position to a ninety-degree open position.

Although only one embodiment of the present invention is set forth herein, it is apparent to someone skilled in the art that various changes and modifications of an obvious nature may be made without departing from the spirit of the invention, and all such changes and modifications are considered to fall within the scope of the invention as defined by the appended claims.

What is claimed is:

1. A door hinge which limits the swing-open motion of a door to which it is attached to a maximum of ninety degrees, said door hinge comprising:

a door frame baseplate, said door frame baseplate having a plurality of substantially cylindrical rotatably joining means located along a joining edge of said baseplate, said joining means having an inside diameter to receive a hinge pin along the vertical axis of the joining means, wherein the rotatably joining means at an upper edge of said baseplate includes a tab which extends downward from a lower surface of said joining means along the vertical axis of the joining means, and wherein the rotatably joining means at a lower edge of said baseplate includes a tab which extends upward from an upper surface of said joining means along the vertical axis of the joining means, a door baseplate, said door baseplate having a plurality of substantially cylindrical rotatably joining means located along a joining edge of said door baseplate, said joining means having dimensions to match the joining means of the door frame baseplate, having an inside diameter to receive a hinge pin along the vertical axis of the joining means and keyed vertically to interpose between adjacent joining means of the door frame baseplate, wherein an uppermost rotatably joining means includes a slot which extends downward from an upper surface of said joining means along the vertical axis of the joining means, and wherein a lowermost rotatably joining means includes a slot which extends upward from the lower surface of said joining means along the vertical axis of the joining means, wherein the tabs of the joining means of the door frame baseplate cooperate with the slots of the joining means of the door baseplate to limit rotation of said door to about ninety degrees, and a hinge pin rotatably connecting said door frame baseplate and said door baseplate.

* * * * *